US008187047B1

(12) United States Patent
Brooks

(10) Patent No.: US 8,187,047 B1
(45) Date of Patent: May 29, 2012

(54) TETHERED FLOTATION DEVICE AND METHOD OF USE THEREOF

(76) Inventor: Charleta Brooks, Myrtle Beach, SC (US)

( * ) Notice: Subject to any disclaimer, the term of this patent is extended or adjusted under 35 U.S.C. 154(b) by 465 days.

(21) Appl. No.: 12/157,872

(22) Filed: Jun. 13, 2008

(51) Int. Cl.
*B63C 9/28* (2006.01)

(52) U.S. Cl. ..... 441/131; 114/345; 441/40

(58) Field of Classification Search ..... 114/345, 114/346, 357; 441/12, 35, 40, 43, 75, 129, 441/130, 131, 132
See application file for complete search history.

(56) References Cited

U.S. PATENT DOCUMENTS

| | | | | |
|---|---|---|---|---|
| 2,075,374 | A | 3/1937 | Tucker | |
| 2,246,108 | A * | 6/1941 | Sermon | 441/131 |
| 2,562,080 | A | 7/1951 | Barnes | |
| 2,724,843 | A | 11/1955 | Kimball | |
| 2,958,876 | A * | 11/1960 | Garrett | 441/131 |
| 4,799,910 | A | 1/1989 | Kellough | |
| 5,046,978 | A * | 9/1991 | Howerton | 441/131 |
| 5,231,951 | A * | 8/1993 | Tagar et al. | 114/345 |
| 5,468,167 | A * | 11/1995 | Givens | 441/40 |
| 5,951,348 | A | 9/1999 | Liong et al. | |
| 6,000,979 | A * | 12/1999 | Stewart | 441/75 |
| 6,126,504 | A | 10/2000 | Day | |
| 6,234,857 | B1 | 5/2001 | Suellentrop | |
| 6,645,026 | B2 * | 11/2003 | Kuan | 441/40 |
| 7,314,399 | B2 * | 1/2008 | Turner | 441/129 |

* cited by examiner

*Primary Examiner* — Lars A Olson
(74) *Attorney, Agent, or Firm* — Montgomery Patent & Design, LLC; Robert C. Montgomery; Joseph T. Yaksich

(57) ABSTRACT

A child's canvas floatation device for use in an ocean, lake, or pool environment comprising a seat system for the child as well as a tether line for connection to a parent's or care provider's wrist is herein disclosed. The flotation device is toroidal being approximately two (2) to three (3) feet in diameter and provided with an inflation port and a series of grasping handles. The device is also provided with a textile covering over most of the entire tube area. The cover is wrapped back upon itself and covers the interior of the inner tube. The center is then provided with a pair of leg holes in which a child can insert his or her legs and be provided with a seat. As such, the child is not in danger of falling through the inner tube as is the case with conventional inner tubes. Additionally, the device is provided with an attached tether line approximately six (6) feet long that attaches to the parent's or care provider's wrist.

17 Claims, 2 Drawing Sheets

TETHERED FLOTATION DEVICE AND METHOD OF USE THEREOF

RELATED APPLICATIONS

The present invention was first described in a notarized Official Record of Invention on Jun. 1, 2007, that is on file at the offices of Montgomery Patent and Design, LLC, the entire disclosures of which are incorporated herein by reference.

FIELD OF THE INVENTION

The present invention relates generally to a buoyant apparatus particularly suited to support a user, most typically a child, thereabove a water surface, said apparatus comprising a tether removably attachable another user, most typically an adult or caregiver.

BACKGROUND OF THE INVENTION

Young children are delicate little beings that require the utmost care in order protect and keep them safe from harm. As a result, there are a myriad of products intended to provide protection from the danger generated by a variety of sources. Car seats protect them from physical harm while riding in a car and sunshades shield their eyes and skin from the harmful effects of ultraviolet light. High chairs secure them at the dinner table, and barriers keep them from falling down stairs and out of beds. The list goes on and on. While there appears to be a product intended to protect infants from a seemingly endless list of dangers, one learning experience they are not protected from is when they are in the water. Of course there are life vest and water wings, but such devices serve to isolate the child from the water rather than letting them play. Accordingly, there is a need for a means by which young children can be protected from harm when in any type of body of water, yet be afforded a playful and fun experience as well. The development of the invention herein described fulfills this need.

U.S. Pat. No. 6,234,857 filed by Suellentrop discloses a pet recreation flotation device. This patent does not appear to disclose an adult-tethered child flotation device.

U.S. Pat. No. 6,126,504 filed by Day discloses an infant flotation device. This patent does not appear to disclose a tethered flotation device.

U.S. Pat. No. 5,951,348 filed by Liong and Isbell discloses a life: preserver for an infant or young child. This patent does not appear to disclose an adult-tethered child flotation device.

U.S. Pat. No. 4,799,910 filed by Kellough discloses a baby recreational floating device. This patent does not appear to disclose an adult-tethered child flotation device with an inflatable bladder, handles and the safety rope disclosed in the instant invention.

U.S. Pat. No. 2,724,843 filed by Kimball discloses a bather's float. This patent does not appear to disclose an adult-tethered child flotation device.

U.S. Pat. No. 2,562,080 filed by Barnes discloses a buoyant sustaining seat. This patent does not appear to disclose an adult-tethered child flotation device.

U.S. Pat. No. 2,075,374 filed by Tucker discloses a saddle float. This patent does not appear to disclose a child flotation device that possesses a tether for attachment to an adult.

The prior art discloses various devices for supporting children in the water. The prior art does not appear to disclose an adult-tethered child flotation device that possesses an inflatable bladder, handles and the other features of the instant invention.

SUMMARY OF THE INVENTION

In view of the foregoing disadvantages inherent in the prior art, it has been observed that there is need for an adult-tethered child flotation device.

It is an object of the adult-tethered child flotation device to provide device and method for a tethered flotation device for use by a small child and a caregiver in an ocean, lake, or pool environment.

An aspect of the adult-tethered child flotation device comprises a central seat system for the child and a tether line for connection thereto a parent's or care provider's wrist.

A further aspect of the adult-tethered child flotation device comprises an inflation port, a series of handles, and an attached tether line approximately six (6) feet long that attaches to a parent's or other care provider's wrist.

Still a further aspect of the adult-tethered child flotation device comprises a bladder with a wrap-around covering enveloping most of the bladder portion. The cover comprises a central seat portion providing two (2) leg holes in which a child can insert his or her legs and be provided with a secure and comfortable seat. As such, the child is not in danger of falling through a center portion of the device as is the case with common inner tubes.

Yet still a further aspect of the adult-tethered child flotation device comprises a bladder portion, a cover portion, and a seat portion. The bladder portion provides a circular and toroidal-shaped inflated base platform comprising a strong waterproof textile canvas material. The bladder is envisioned being similar to other air-filled water sport devices; however, provides additional enhancements for the safe and secure transportation of an occupying toddler or small child in an ocean, lake, or swimming pool environment by a parent or care-giver. The bladder comprises a buoyant platform approximately two (2) to three (3) feet in diameter, thereby providing lateral stability thereto the child. However, the bladder is envisioned to be introduced in a variety of inner and outer diameters corresponding to different sized infants, toddlers, and small children. The bladder portion further comprises a tether cord, a plurality of safety rope anchors, a pair of occupant handles, and an adult handle. The bladder may be provided in a variety of colors, patterns, logos, personalized indicia, and the like based upon a user's preference. The bladder further comprises an inflation port therealong an upper surface providing a common flush-mount and deployable plug-valve device for inflation of the device using an oral means or an air pump in a conventional manner.

Yet another aspect of the adult-tethered child flotation device comprises a bladder portion that provides an attachment means thereto a tether cord via a rectangular-shaped tether attachment panel located at a proximal end thereof said tether cord and affixed to the bladder portion. The tether attachment panel comprises an integrally molded portion of the tether cord being made using urethane or rubber. The tether cord is envisioned to be approximately one-quarter (¼) inch in diameter and six (6) feet long being similar in construction thereto common surf board tethers. Additionally, the tether cord is envisioned to provide a break-away safety feature typically required for use in controlled oceanfront areas. The tether cord further provides an attachment means thereto a wrist strap at a distal end thereof. The wrist strap comprises a strong nylon strapping material approximately one (1) inch wide forming a cuff therearound a caregiver's wrist in an expected manner being affixed along end portions preferably using hook-and-loop strips, thereby providing a comfortable snug fit thereto a variety of wrist circumferences.

Still yet another aspect of the adult-tethered child flotation device comprises a bladder further provides an attachment means thereto a perimeter safety rope being laced therethrough a plurality of rope anchors permanently attached thereto said bladder being equidistantly arranged along an outer equator region of the bladder. The safety rope provides a safety grasping means thereto the device and occupying child, thereby meeting common safety regulations imposed by beaches and other controlled water sport areas. The rope is envisioned to be approximately three-eighths (%) of an inch in diameter and made using marine grade braded nylon or other waterproof braded synthetic rope. The rope anchors comprise half-loop appendages made using urethane or rubber material having integrally molded circular attachment pads affixed thereto an outer equator region of the bladder using either sewing, adhesives, or a combination of both forming a watertight rugged connection thereto.

Yet still a further aspect of the bladder further comprises a pair of occupant handles and an adult handle providing a secure gripping means by an occupying child and a caregiver, respectively, while moving thereacross a water surface in an expected manner. The adult handle provides a positional control means thereto a caregiver during use. The handles comprise rugged half-oval urethane or rubber molded grasping devices having a central opening proportionally sized to receive a child and an adult's fingers, respectively. The handles are affixed therealong an upper surface of the bladder using similar attaching methods as the tether attachment and rope anchors. The adult handle is located along an upper surface of the bladder directly behind an occupying child.

Another aspect of the adult tethered child flotation device comprises a cover portion, a seat portion, and a pair of leg apertures. The cover comprises a pair of closed cylindrical shapes formed therearound opposing sides of the bladder portion each enclosing approximately one-quarter (¼) of a circumferential surface of said bladder. The cover further comprises a joining textile panel therebetween said sewn cylindrical elements comprising a recessed hemi-spherically-shaped seat portion. The seat portion provides security, comfort, and containment thereto the child via a suspended and cup-shaped central portion while floating thereupon various anticipated calm and choppy water surfaces. The seat portion comprises a pair of stabilizing leg apertures at side front locations of the seat portion being subjacent thereto the aforementioned occupant handles The leg apertures are to be sized appropriately so as to comfortably receive a child's leg portion.

A method for installing and utilizing the device may be achieved by performing the following steps: inflating the device either manually or using an air pump via the inflation port; placing the inflated device in shallow water providing a stable standing position thereto a caregiver; lifting and placing an infant or small child into the seat portion of the device by inserting the child's leg portions therethrough the two (2) leg apertures until the child is in a comfortable sitting position; instructing the child to grasp and hold each occupant handle; securing the wrist strap about a caregiver's wrist using the hook-and-loop strips; grasping the adult handle; towing the device and the occupying child along a water surface as desired; using the tether cord as an umbilical to obtain a desired distance therefrom the device and child or to allow a caregiver to swim with the device and child in tow; and, enjoying the security and safety afforded a child and caregiver while utilizing the present invention while conforming to all regulations applicable thereto water sport equipment.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
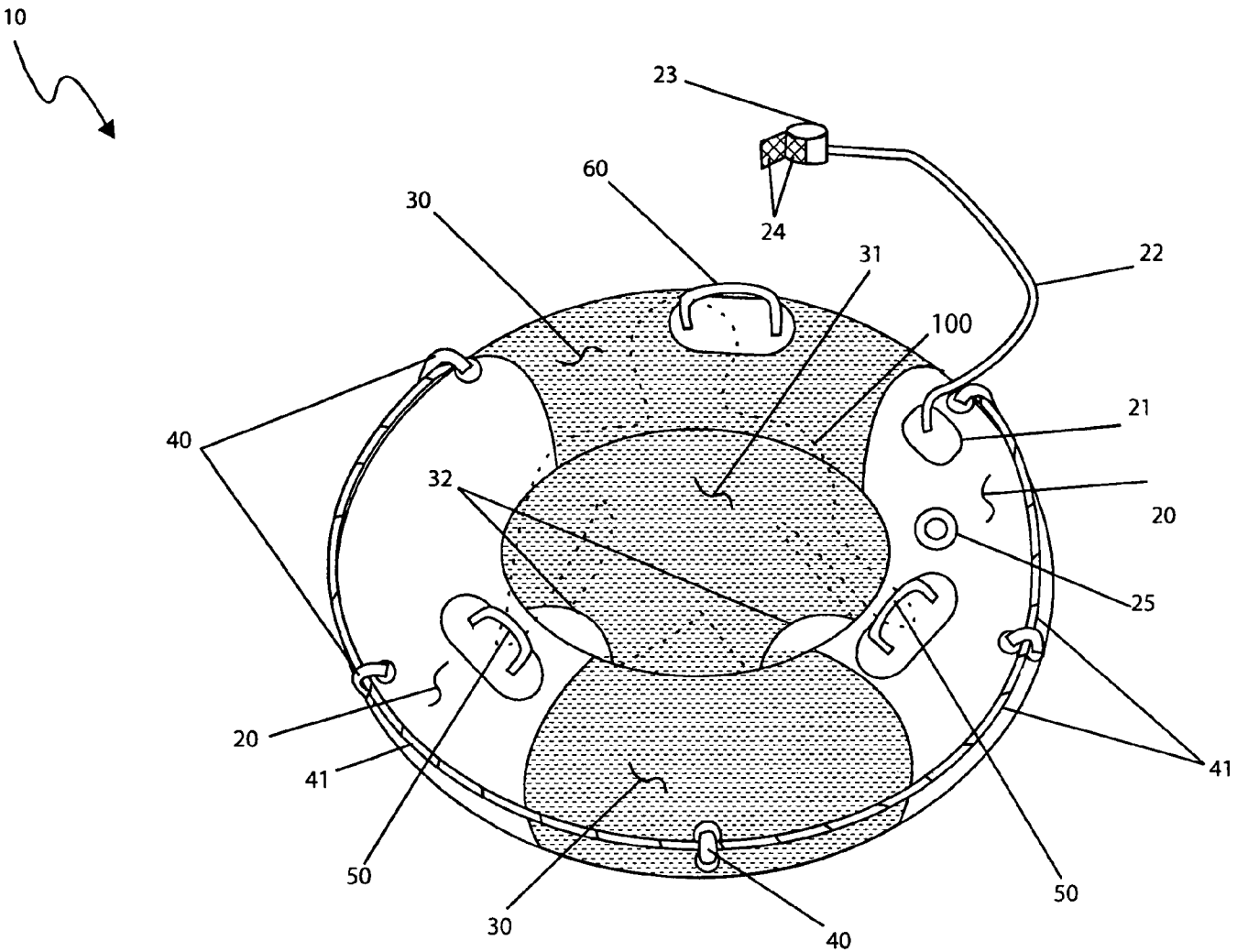
FIG. 1 is a top perspective view of a tethered flotation device 10, according to a preferred embodiment of the present invention; and, FIG. 2 is a side perspective view of a tethered flotation device 10, according to a preferred embodiment of the present invention.

10 tethered flotation device
20 bladder portion
21 tether attachment
22 tether cord
23 wrist strap
24 hook-and-loop strip
25 inflation port
30 cover portion
31 seat portion
32 leg aperture
40 rope anchor
41 safety rope
50 occupant handle
60 adult handle
100 child

DETAILED DESCRIPTION OF THE PREFERRED EMBODIMENT

Figure 2:
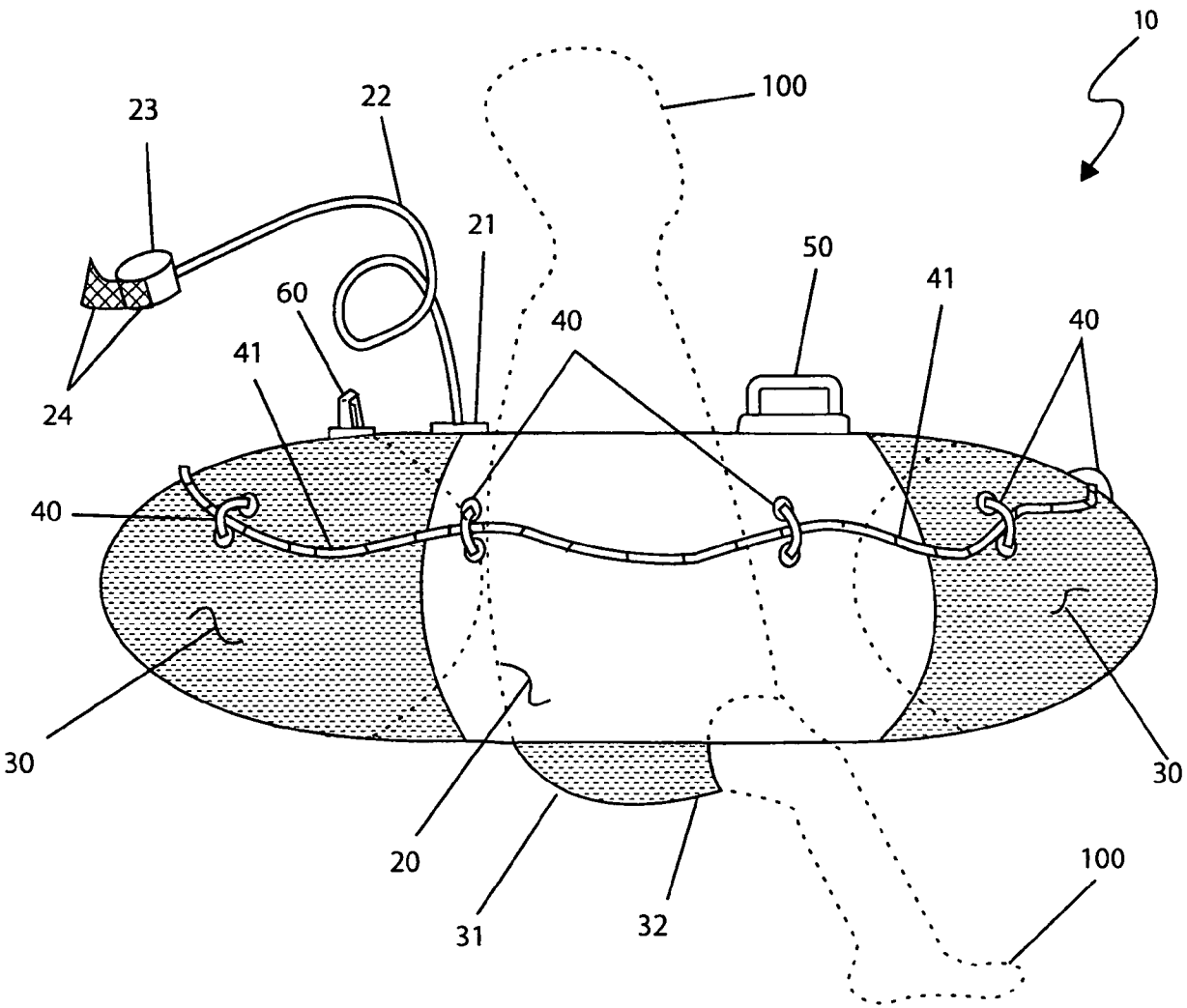

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a tethered flotation device (herein described as the "device") 10, for use by a small child 100 and a caregiver in an ocean, lake, or pool environment comprising a central seat system for the child 100 as well as a tether line 22 for connection thereto a parent's or care provider's wrist. The device 10 is envisioned to be approximately two (2) to three (3) feet in diameter and provided with an inflation port 25, a series of handles 50, and an attached tether line 22 approximately six (6) feet long that attaches to a parent's or other care provider's wrist. The device 10 is also provided with a wrap-around covering 30 enveloping most of the bladder portion 20, The cover 30 comprises a central seat portion 31 providing two (2) leg holes 32 in which a child 100 can insert his or her legs and be provided with a secure and comfortable seat. As such, the child 100 is not in danger of falling through a center portion of the device 10 as is the case with common inner tubes.

Referring now to FIG. 1, a top perspective view of the device 10, according to the preferred embodiment of the present invention, is disclosed. The device 10 comprises a bladder portion 20, a cover portion 30, and a seat portion 31. The bladder portion 20 provides a circular and toroidal-shaped inflated base platform comprising a strong waterproof textile canvas material. The bladder 20 is envisioned being similar to other air-filled water sport devices; however, provides additional enhancements for the safe and secure transportation of an occupying toddler or small child 100 in an ocean, lake, or swimming pool environment by a parent or care-giver. The bladder 20 comprises a buoyant platform approximately two (2) to three (3) feet in diameter, thereby providing lateral stability thereto the child 100. However, the bladder 20 is envisioned to be introduced in a variety of inner and outer diameters corresponding to different sized infants, toddlers, and small children 100. The bladder portion 20 further comprises a tether cord 22, a plurality of safety rope anchors 40, a pair of occupant handles 50, and an adult handle 60. Further more, the bladder 20 may be provide in a variety of colors, patterns, logos, personalized indicia, and the like based upon a user's preference.

The bladder portion 20 provides an attachment means thereto a tether cord 22 via a rectangular-shaped tether attachment panel 21 located at a proximal end thereof said tether cord 22 being affixed thereto the bladder portion 20 using either sewing, adhesives, or a combination of both forming a watertight rugged connection thereto. The tether attachment panel 21 comprises an integrally molded portion of the tether cord 22 being made using urethane or rubber. The tether cord 22 is envisioned to be approximately one-quarter (¼) inch in diameter and six (6) feet long being similar in construction thereto common surf board tethers. Additionally, the tether cord 22 is envisioned to provide a break-away safety feature typically required for use in controlled oceanfront areas. The tether cord 22 further provides an attachment means thereto a wrist strap 23 at a distal end thereof. The wrist strap 23 comprises a strong nylon strapping material approximately one (1) inch wide forming a cuff therearound a caregiver's wrist in an expected manner being affixed along end portions preferably using hook-and-loop strips 24, thereby providing a comfortable snug fit thereto a variety of wrist circumferences.

The bladder 20 further provides an attachment means thereto a perimeter safety rope 41 being laced therethrough a plurality of rope anchors 40 permanently attached thereto said bladder 20 being equidistantly arranged along an outer equator region of the bladder 20. The safety rope 41 provides a safety grasping means thereto the device 10 and occupying child 100, thereby meeting common safety regulations imposed by beaches and other controlled water sport areas. The rope 41 is envisioned to be approximately three-eighths (%) of an inch in diameter and made using marine grade braded nylon or other waterproof braded synthetic rope. The rope anchors 40 comprise half-loop appendages made using urethane or rubber material having integrally molded circular attachment pads affixed thereto an outer equator region of the bladder 20 using either sewing, adhesives, or a combination of both forming a watertight rugged connection thereto. The bladder 20 further comprises a pair of occupant handles 50 and an adult handle 60 providing a secure gripping means by an occupying child 100 and a caregiver, respectively, while moving thereacross a water surface in an expected manner. The adult handle 60 provides a positional control means thereto a care-giver during use. The handles 50, 60 comprise rugged half-oval urethane or rubber molded grasping devices having a central opening proportionally sized to receive a child 100 and an adult's fingers, respectively. The handles 50, 60 are affixed therealong an upper surface of the bladder 20 using similar attaching methods and construction as the aforementioned tether attachment 21 and rope anchors 40. The occupant handles 50 are arranged in alignment therewith subjacent leg aperture portions 32 of the seat portion 31 (see FIG. 2). Further, the adult handle 60 is envisioned to be located along an upper surface of the bladder 20 directly behind an occupying child 100.

The bladder 20 further comprises an inflation port 25 therealong an upper surface providing a common flush-mount and deployable plug-valve device for inflation of the device 10 using an oral means or an air pump in a conventional manner.

Referring now to FIG. 2, a side perspective view of the device 10, according to the preferred embodiment of the present invention, is disclosed. The device 10 comprises a cover portion 30, a seat portion 31, and a pair of leg apertures 32. The cover 20 provides a secure attachment thereto the bladder 20 comprising textile assembly made using nylon fabric or equivalent rugged waterproof and mildew-proof material constructed using conventional textile processes. The cover 30 is envisioned to be introduced in a variety of colors, patterns, logos, personalized indicia, and the like based upon a user's preference. The cover 30 comprises a pair of closed cylindrical shapes formed therearound opposing sides of the bladder portion 20 each enclosing approximately one-quarter (¼) of a circumferential surface of said bladder 20. The cover 30 further comprises a joining textile panel therebetween said sewn cylindrical elements comprising a recessed hemi-spherically-shaped seat portion 31. The seat portion 31 provides security, comfort, and containment thereto the child 100 via a suspended and cup-shaped central portion while floating thereupon various anticipated calm and choppy water surfaces. The seat portion 32 comprises a pair of stabilizing leg apertures 32 at side front locations of the seat portion 32 being subjacent thereto the aforementioned occupant handles 50. The leg apertures 32 are to be sized appropriately so as to comfortably receive a child's leg portion 100 therethrough in an expected manner.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIG. 1.

The method of and utilizing the device 10 may be achieved by performing the following steps: inflating the device 10 either manually or using an air pump via the inflation port 25; placing the inflated device 10 in shallow water providing a stable standing position thereto a caregiver; lifting and placing an infant or small child 100 into the seat portion 31 of the device 10 by inserting the child's leg portions 100 therethrough the two (2) leg apertures 32 until the child 100 is in a comfortable sitting position; instructing the child 100 to grasp and hold each occupant handle 50; securing the wrist strap 23 about a caregiver's wrist using the hook-and-loop strips 24; grasping the adult handle 60; towing the device 10 and the occupying child 100 along a water surface as desired; using the tether cord 22 as an umbilical to obtain a desired distance therefrom the device 10 and child 100 or to allow a caregiver to swim with the device 10 and child 100 in tow; and, enjoying the security and safety afforded a child 100 and caregiver while utilizing the present invention 10 while conforming to all regulations applicable thereto water sport equipment.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tethered flotation device comprising:

a bladder portion comprising:

a buoyant platform;

a tether cord, comprising a proximal end having an integral tether attachment panel attached to said buoyant platform;

a plurality of safety rope anchors positioned on an outer surface of said buoyant platform;

a plurality of handles attached to said buoyant platform for providing a secure gripping surface; and, an inflation port formed along an upper surface thereof; and, a cover portion for providing a secure attachment to said bladder portion, said cover portion comprising:

a pair of cylindrical elements directly attached around opposing sides of said bladder portion; and, a panel positioned between said cylindrical elements, said panel comprising a recessed seat portion, said seat portion being positioned centrally to said buoyant platform and comprising a pair of stabilizing leg apertures at a side front location of said seat portion;

wherein said panel forms a substantially majority portion between said cylindrical elements; and, wherein a proximal end of said tethered cord is attached to said outer surface of said buoyant platform and remains spaced from said cylindrical elements and said panel respectively.

2. The device of claim 1, wherein said cylindrical elements are configured to wrap-around a partial area of said bladder portion.

3. The device of claim 1, wherein said plurality of handles of said bladder portion comprise: a pair of occupant handles and an adult handle, said handles being formed from half-oval molded grasping devices having a central opening proportionally sized to receive occupant and adult fingers therethrough.

4. The device of claim 3, wherein said plurality of handles are affixed along an upper surface of said bladder, said occupant handles being aligned with each of said leg apertures of said seat portion.

5. The device of claim 3, wherein said adult handle is located along an upper surface of said bladder portion, said adult handle located aft of said pair of leg apertures directly behind an occupant residing within said device.

6. The device of claim 1, wherein said tether cord comprises: a wrist strap disposed at a distal end thereof, said wrist strap being formed from nylon and including hook-and-loop strips for being configured about a wrist of a caregiver.

7. The device of claim 1, wherein said bladder portion further comprises:

a plurality of rope anchors permanently attached to a perimeter of said buoyant platform; and, a safety rope laced through said rope anchor, said plurality of rope anchors being equidistantly arranged along an outer region of said buoyant platform.

8. The device of claim 3, wherein said leg apertures of said seat portion are positioned subjacent to said occupant handles and within an inner perimeter of said buoyant platform.

9. A tethered flotation device comprising:

a bladder portion comprising:

an inflatable buoyant platform;

a tether cord attached to said buoyant platform via a tether attachment panel integral to a proximal end thereof, said tether cord being configured to adjustably connect to a wrist of a care provider;

a plurality of safety rope anchors parametrically positioned on an outer surface of said buoyant platform;

a plurality of handles directly attached to said buoyant platform for providing a secure gripping surface; and, an inflation port formed along an upper surface thereof; and, a cover portion for providing a secure attachment to said bladder portion, said cover portion comprising:

a pair of closed cylindrical elements directly attached around opposing sides of said bladder portion; and, a panel positioned between said cylindrical elements, said panel comprising a recessed seat portion, said seat portion being positioned centrally to said buoyant platform and comprising a pair of stabilizing leg apertures at a side front location of said seat portion;

wherein said panel forms a substantially majority portion between said cylindrical elements; and, wherein said proximal end of said tether cord is statically attached to said buoyant platform and a distal end of said tether cord is free to dynamically move independently of a position of said panel.

10. The device of claim 9, wherein said cylindrical elements are configured to wrap-around a partial area of said bladder portion.

11. The device of claim 9, wherein said plurality of handles of said bladder portion comprise: a pair of occupant handles and an adult handle, said handles being formed from half-oval molded grasping devices having a central opening proportionally sized to receive occupant and adult fingers therethrough.

12. The device of claim 11, wherein said plurality of handles are affixed along an upper surface of said bladder, said occupant handles being aligned with each of said leg apertures of said seat portion.

13. The device of claim 11, wherein said adult handle is located along an upper surface of said bladder portion, said adult handle located aft of said pair of leg apertures directly behind an occupant residing within said device.

14. The device of claim 9, wherein said tether cord comprises:

a wrist strap disposed at said distal end thereof, said wrist strap being formed from nylon and including hook-and-loop strips for being configured about a wrist of a caregiver.

15. The device of claim 9, wherein said bladder portion further comprises:

a plurality of rope anchors permanently attached to a perimeter of said buoyant platform; and a safety rope laced through said rope anchor, said plurality of rope anchors being equidistantly arranged along an outer region of said buoyant platform.

16. The device of claim 11, wherein said leg apertures of said seat portion are positioned subjacent to said occupant handles and within an inner perimeter of said buoyant platform.

17. A method of using a tethered floating device, said method comprising the steps of:

a. providing a bladder portion comprising an inflatable buoyant platform, a tether cord attached to said buoyant platform via a tether attachment panel integral to a proximal end thereof, said tether cord being configured to adjustably connect to a wrist of a care provider, a plurality of safety rope anchors parametrically positioned on an outer surface of said buoyant platform, a plurality of handles directly attached to said buoyant platform for providing a secure gripping surface, and an inflation port formed along an upper surface thereof;

b. providing and securely attaching a cover portion to said bladder portion, said cover portion comprising a pair of closed cylindrical elements directly attached around opposing sides of said bladder portion, and a panel positioned between said cylindrical elements, said panel comprising a recessed seat portion, said seat portion being positioned centrally to said buoyant platform and comprising a pair of stabilizing leg apertures at a side front location of said seat portion;

wherein said panel forms a substantially majority portion between said cylindrical elements;

c. inflating said buoyant platform;

d. placing said inflated buoyant platform in a shallow water for providing a stable standing position for a care provider;

e. lifting and placing an occupant into said seat portion by inserting occupant leg portions through said pair of leg apertures until the occupant is in a comfortable sitting position;

f. instructing the occupant to grasp and hold one of said handles;

g. securing a wrist strap around a wrist of the care provider;

h. grasping another one of said handles; and, i. using said tether cord as an umbilical to obtain a desired distance from said buoyant platform and said occupant towing said buoyant platform and said occupant along a water surface as desired;

wherein said tether attachment panel is statically mated to said outer surface of said buoyant platform.

* * * * *